United States Patent [19]

Duke et al.

[11] 4,247,059

[45] Jan. 27, 1981

[54] LIGHT EMITTING DIODE BEACONS FOR COMMAND GUIDANCE MISSILE TRACK LINKS

[75] Inventors: Jimmy R. Duke; Walter E. Miller, Jr.; Dorwin L. Kilbourn; Nicholas J. Mangus, Jr.; Robert L. Sitton; Walter F. Fountain, all of Huntsville, Ala.

[73] Assignee: The United States of America as represented by the Secretary of the Army, Washington, D.C.

[21] Appl. No.: 954,793

[22] Filed: Oct. 25, 1978

[51] Int. Cl.[3] ..... F41G 7/00; F42B 15/02; G06F 15/50

[52] U.S. Cl. ..... 244/3.16; 244/3.12

[58] Field of Search ..... 244/3.11, 3.12, 3.16

[56] References Cited

U.S. PATENT DOCUMENTS

| | | | |
|---|---|---|---|
| 3,227,882 | 1/1966 | Bissett et al. . | |
| 3,366,346 | 1/1968 | McKnight et al. | 244/3.11 |
| 4,027,837 | 6/1977 | Miller, Jr. et al. | 244/3.16 |
| 4,034,949 | 7/1977 | Hoesterey et al. | 244/3.16 |
| 4,047,678 | 9/1977 | Miller, Jr. et al. | 244/3.16 |

*Primary Examiner*—Theodore M. Blum

*Attorney, Agent, or Firm*—Nathan Edelberg; Robert P. Gibson; Freddie M. Bush

[57] ABSTRACT

An improved automatic missile tracking and guidance system wherein a launched missile is guided along a line-of-sight maintained by the operator with the target. The position of an infrared source disposed on the missile is detected and guidance signals generated in accordance therewith to control the flight of the missile along the line-of-sight. The infrared source or beacon disposed on the missile comprises an array of semiconductor light emitting diodes. The solid state characteristics of the light emitting diodes provide heretofore unobtainable reliability over existing beacons. The beacon may be used to produce a modulated, high frequency, rectangular waveform, incoherent emission offering performance improvements including virtual immunity to optical countermeasures.

3 Claims, 5 Drawing Figures

LIGHT EMITTING DIODE BEACONS FOR COMMAND GUIDANCE MISSILE TRACK LINKS

DEDICATORY CLAUSE

The invention described herein may be manufactured, used, and licensed by or for the Government for governmental purposes without the payment to us of any royalties thereon.

BACKGROUND OF THE INVENTION

Various methods and systems have been developed for command guidance of air-to-ground or ground-to-ground missiles. Some of these systems comprise an infrared tracker which senses the deviations of a missile from the line-of-sight to a selected target and a command signal processor which provides signals to the missile to cause it to fly along this path. The operator's sole function is to maintain the line-of-sight path on the target, with the aid of a sight aligned to the tracker, whereby the missile is caused to impact the target. Such a system is disclosed in U.S. Pat. No. 3,366,346. Unmodulated sources as well as modulated tungsten flares, xenon lamps, or other sources of infrared are used to provide a unique infrared signature (beacon) on the missile to aid the tracking capability of the tracker. It is desired that these systems function precisely under adverse conditions existant on the battle field. Certain performance capabilities of systems now known and used are limited by the low frequency modulation capabilities of these beacons, and by their spectral broadness.

SUMMARY OF THE INVENTION

An automatic missile tracking and guidance system is provided wherein an array of photoemissive diodes are used as the beacon on the missile. The modulated beacon provides a high frequency, rectangular waveform, incoherent emission signature with spectral narrowness. The modulated frequency capability of these diodes extends from DC to very high frequency. This provides the capability of operating at low frequencies with existing trackers or at high frequencies with improved trackers. The improved tracker which detects the position of the beacon with respect to the line-of-sight to the target may use a band pass filter to pass only the high frequency modulation of the beacon to thus make the improved tracking and guidance system virtually immune to low frequency interference sources.

DESCRIPTION OF THE PREFERRED EMBODIMENT

Figure 1:
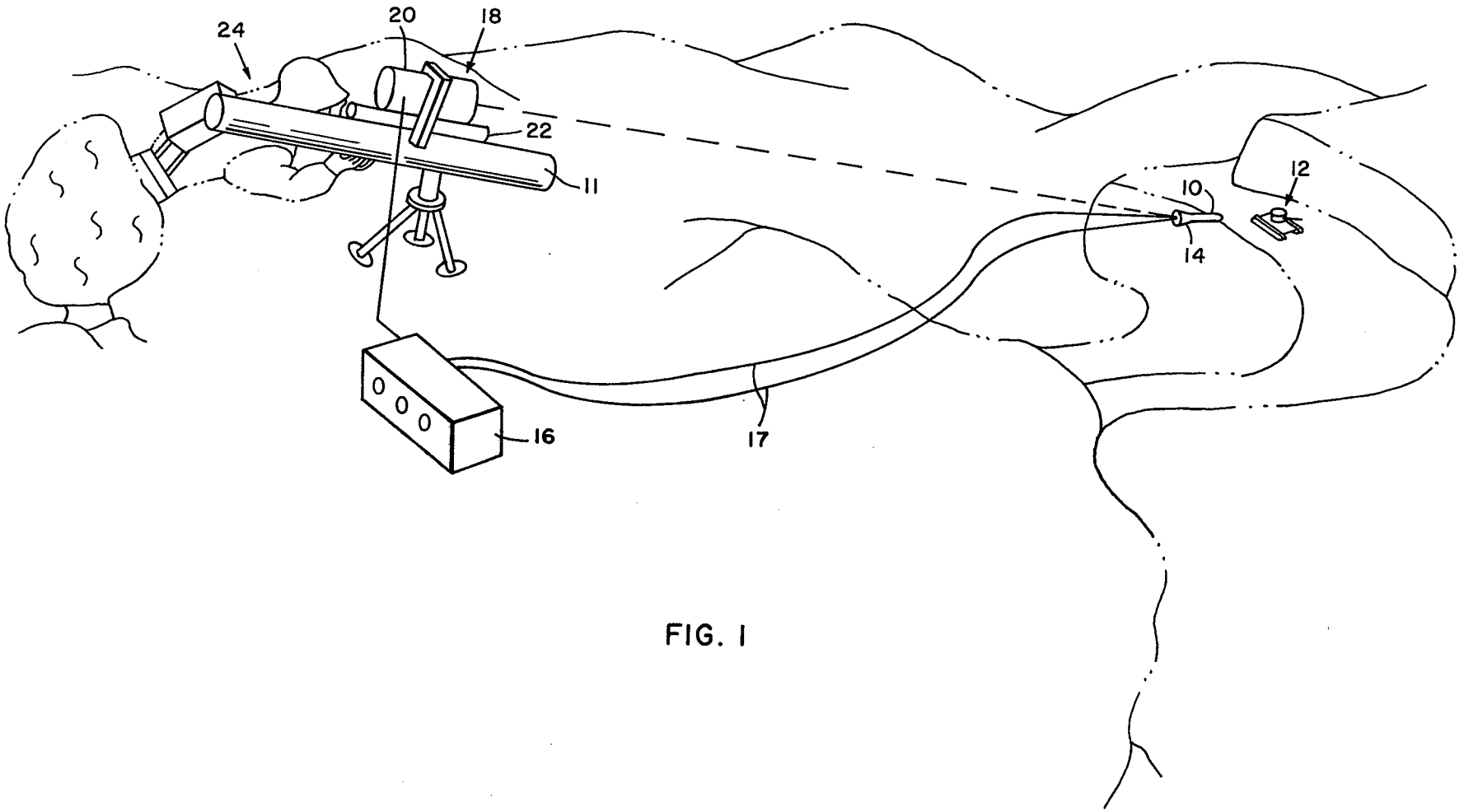
FIG. 1 is a pictorial representation of an automatic missile system.

Referring now to the drawings wherein like numbers refer to like parts, FIG. 1 discloses a missile 10 in flight on a line-of-sight path to target 12. A beacon 14 is attached to the missile. Missile 10, after launch from a launcher 11, is guided by signals from a command signal processor 16, responsive to a control assembly 18. Control assembly 18 comprises a missile tracking unit 20 which provides tracking signals and a telescope 22 which provides a means to sight the target. The telescope and the tracking unit have their axes aligned for sighting on distant targets.

To launch a missile at a target, an operator 24 sights on the target through the telescope and pulls a trigger on the launcher, which controls the launch circuit. The operator maintains target 12 in the sight until the missile collides with the target. Tracking unit 20 detects the position of the missile beacon with respect to the line-of-sight established with the target and provides input signals to the command signal processor 16. The command signal processor transmits corrective guidance signals to the missile to maintain the missile on the line-of-sight to the target. Signal transmission may be by wires 17 as shown or by other common means.

The present invention is directed particularly to beacon 14 which provides by virtue of its unique signature, improved tracking performance and greater ability to discriminate against other signatures. Other advantages such as solid state reliability and reduced power consumption also accrue.

The light emitting diode beacon disclosed in FIG. 2 may be used as follows. Missile beacon 14 includes a light emitting diode array 30, modulated by a rectangular waveform current from a modulator 32, to provide the light emitting element of the beacon. At the tracking station light received from the beacon array 30 is processed by infrared tracker 20 to provide signals indicative of the missile position. These position signals are processed by command signal processor 16 into guidance commands, which are then sent to the missile via wire 17 to direct the missile back to the guidance axis null.

Figure 2:
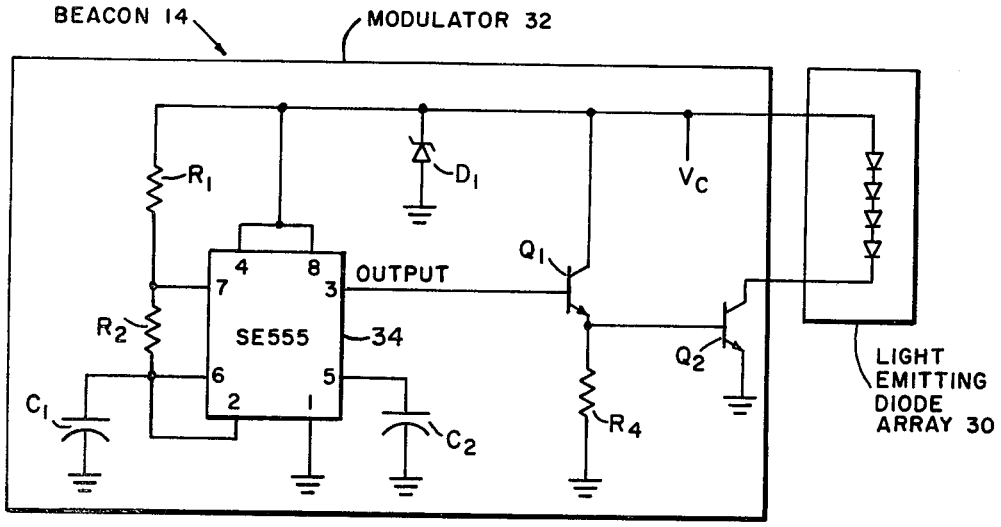
FIG. 2 is a block diagram schematic of a high frequency, continuous wave modulation guidance link for the missile beacon.

FIG. 2 discloses a particular modulator 32 which generates a current waveform for driving diode array 30 to produce a rectangular waveform, continuous frequency, incoherent infrared signature. Modulator 32 is comprised of a rectangular waveform, crystal controlled clock 34, such as an SE 555 integrated circuit, a buffer amplifier, and a driver transistor. Transistor $Q_1$ with resistor $R_4$ functions as the buffer amplifier for coupling the output of the SE 555 through the base and emitter of $Q_1$ to driver $Q_2$. The emitter of $Q_1$ is coupled to the base of $Q_2$, controlling driver $Q_2$. The emitter of $Q_2$ is coupled to ground and the collector is coupled through diode array 30 to the input power source Vc. Vc is further coupled to provide operating voltage to the modulator circuit. Zener diode $D_1$ provides regulation of the voltage to the SE 555. Series resistors $R_1$ and $R_2$ and $C_1$ provide a voltage divider Vc. Vc is further coupled to provide operating voltage to the SE 555. Series resistors $R_1$ and $R_2$ and $C_1$ provide a voltage divider and charging network for the SE 555, thereby controlling the output frequency and duty factor of the signal driving $Q_1$. $C_2$ stabilizes the bias voltage. $Q_1$ couples the signal to $Q_2$ which drives the diode array on and off at the desired modulation frequency. The frequency is determined by the ratio of $$\frac{1.44}{(R_1 + 2R_2)C_1}.$$

The duty factor is the ratio of $$\frac{R_2}{R_1 + 2R_2}.$$

The light emitting diode beacon 14 may be substituted for any state-of-the-art beacon without having to modify the existing track link. The upper limits of continuous wave modulation for modulator 32 are extended beyond 2 MHz by a GaAs beacon as compared to less than 50 KHz for prior art beacons. This high frequency operation capability, together with the very good frequency stability of solid state modulators greatly improves the ability of improved trackers to discriminate against noise and other signatures.

Figure 5:
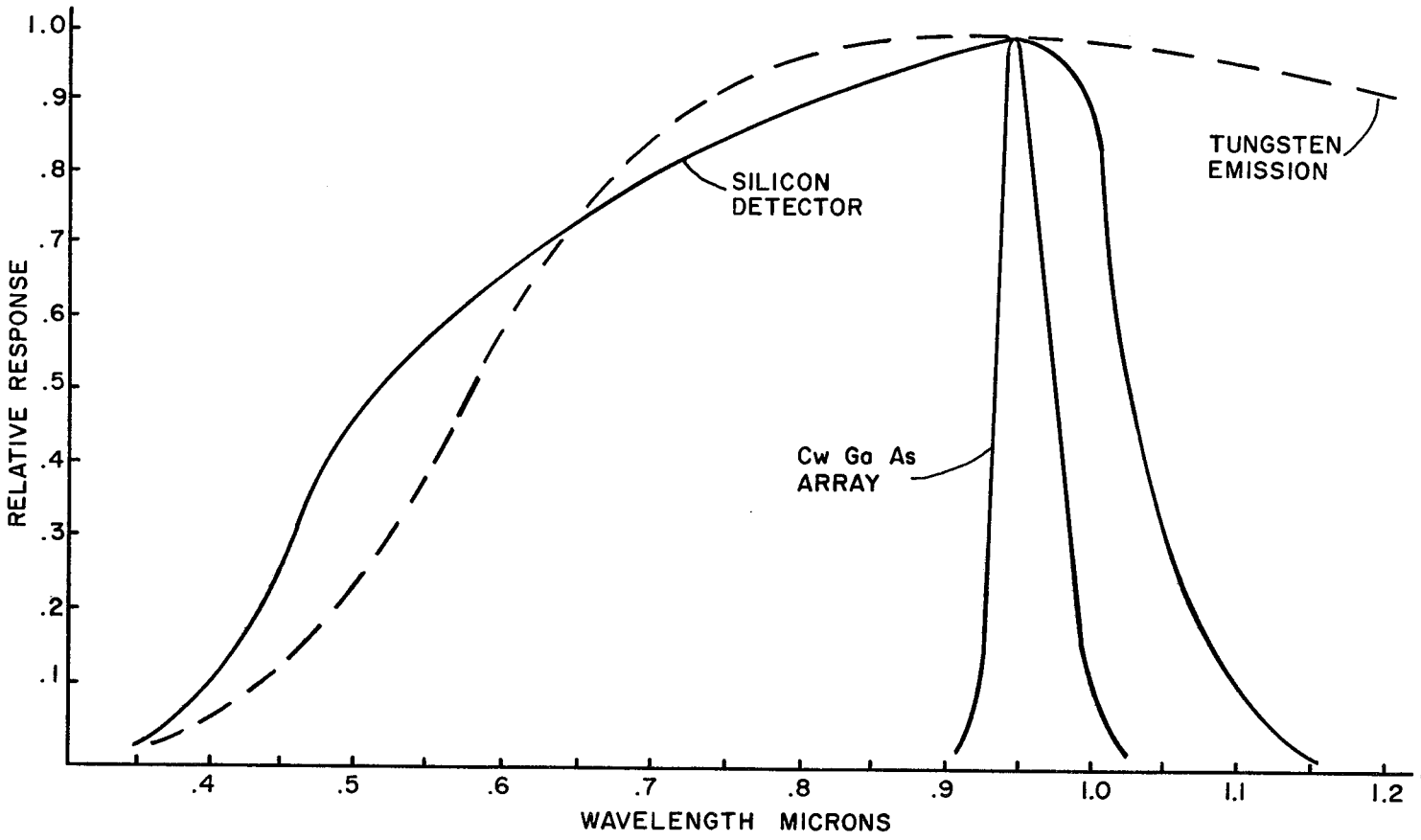
FIG. 5 is a graph of the spectral response of a silicon detector compared with the spectral emission of GaAs diodes and tungsten flares.

As shown in FIG. 5, high power incoherent GaAs diodes provide a narrow spectral bandwidth on the order of 250 Å—500 Å wide, permitting spectral bandwidth reduction of the tracker by spectral filtering by approximately a factor of 10 as compared to an unfiltered silicon detector. The power input requirements of the continuous wave diodes are easily compatible with simple transistor drive circuitry. This provides solid state reliability, as well as growth potential for more sophisticated modulation techniques, such as crystal controlled frequency modulation, optimum digital codes, frequency control by the tracker or diversified frequency operation in which the operating frequency, one of many within a band, is selected at launch.

Figure 3:
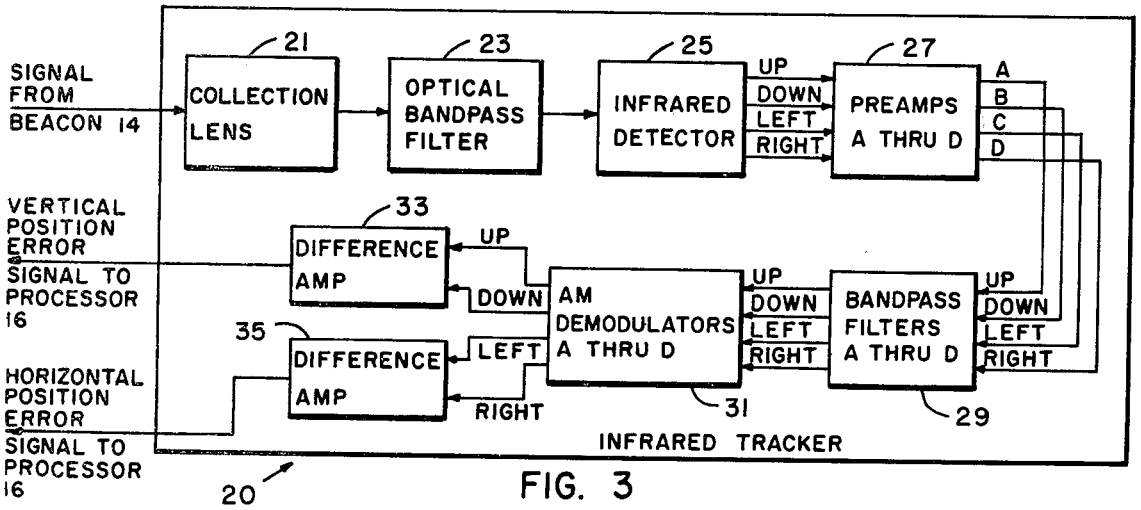
FIG. 3 is a block diagram of a typical infrared tracker.
Figure 4:
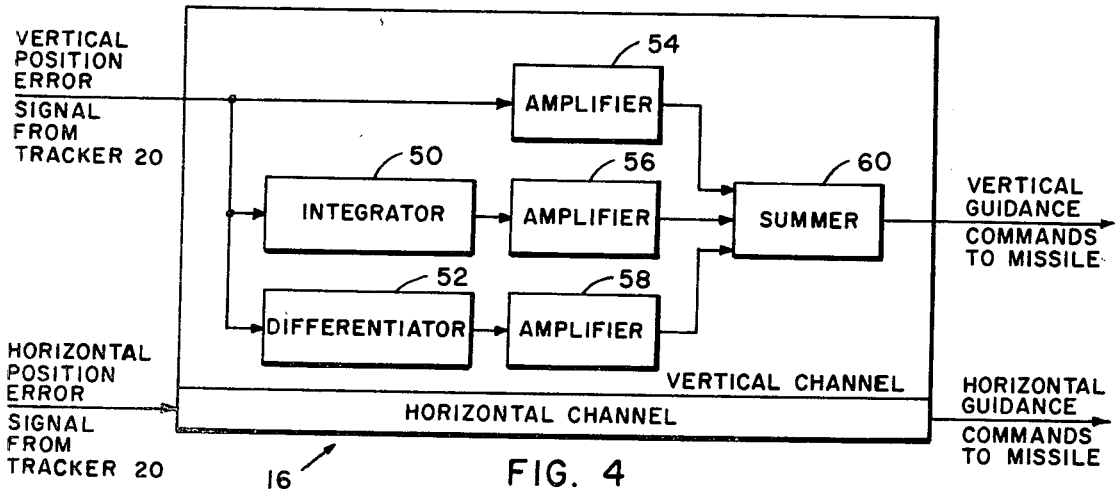
FIG. 4 is a block diagram of a typical command signal processor.

The infrared tracker 20, and command signal processor 16 are well known functions, and may be implemented in several ways; however, simplified implementations are described in FIGS. 3 and 4 respectively.

The infrared tracker 20 of FIG. 3 receives the beacon modulated energy by collection lens 21, and focuses it on detector 25 through the optical bandpass filter 23. Detector 25 is a position sensing detector (such as a PIN-SC/10 made by United Detector Technology) with four outputs. These outputs are amplified respectively by preamplifiers 27A through D, filtered respectively by bandpass filters 29A through 29D, and converted to dc voltages by AM detectors 31A through 31D. The vertical channel signals from the AM detectors 31A and B are subtracted by difference amplifiers 33 to produce the vertical position error signal sent to the vertical channel of processor 16. The output signal of difference amplifier 33 is a voltage which is zero when the missile is on the tracker optical axis, and a positive or negative voltage proportional to missile vertical position if the missile is not on axis. Processing in the horizontal channel of the signals from AM detectors 31C and D is identical to that in the vertical channel. Further refinements, such as addition of automatic gain control to reduce signal amplitude variations and an electronics range program to convert angular errors to linear errors as a function of missile range are obvious.

The command signal processor is shown functionally in FIG. 4. Typically, vertical error signals are coupled from tracker 20 into an integrator 50, a differentiator 52, and an amplifier 54. Outputs of integrator 50 and differentiator 52 are coupled respectively to amplifiers 56 and 58. The outputs of the three amplifiers are added in summing circuit 60. The time constants of circuits 50 and 52, and the gain values of amplifiers 54, 56, and 58 are normally determined by missile system simulation, using available models of aerodynamics, mass, inertial and velocity profile characteristics of the missile, as well as target velocity and acceleration capabilities. In general, the choices determine whether a missile is very stable and sluggish, or less stable and highly maneuverable in the vertical axis.

The missile vertical position error signal is directly coupled to summer 60 through amplifier 54; integrated by integrator 50, and coupled to summer 60 by amplifier 56; and differentiated by differentiator 52 and coupled to summer 60 by amplifier 58. The sum output is an analogue voltage which is used to command the missile in response to its positional errors in the vertical axis. Processing of horizontal errors in the horizontal channel is identical to that described for the vertical channel.

It is to be understood that the form of the invention, herewith shown and described is to be taken as a preferred example of the same, and that various changes may be resorted to without departing from the spirit and scope of the invention. Accordingly, the scope of the invention is to be limited only by the claims appended hereto.

We claim:

1. In an automatic missile tracking and guiding system wherein a launched missile is guided along a line-of-sight- maintained by the operator to a target, the system having tracking means for tracking a missile and guidance means for developing missile steering signals proportional to the deviation of the missile from the line-of-sight, the improvement comprising: an array of infrared photoemissive diodes disposed on said missile for directing optical emission to the rear thereof; a modulator coupled to said diode array for modulating the array output signal; said modulator comprising a rectangular waveform clock generator, a buffer amplifier having an input coupled to said clock, and a driver circuit coupled between said buffer amplifier and said diode array, said clock generator being an integrated circuit, said buffer amplifier being a transistor amplifier having the base coupled as said input and the emitter coupled to provide an output to said driver circuit, and said driver circuit being a transistor having a base input from said buffer amplifier and having the diode array coupled in series through the collector and emitter for driving said array at the clock output frequency; a remotely located infrared detection means for detecting the position of said array with respect to said line-of-sight, said infrared detection means comprising a detector positioned to receive and detect emission from said diode array and provide an output responsive to said received signal and an optical band pass filter for filtering optical energy impinging on said detector; and signal processing means coupled to said detector output for providing an output signal to said guidance means indicative of the position of said missile respective to said line-of-sight.

2. In an automatic missile guidance system as set forth in claim 1, the improvement further comprising first and second resistors coupled in series and coupled to said clock for providing a selectable, precise duty factor, and a capacitor coupled between one side of said series coupled resistors and ground for providing in conjunction with said resistors the frequency of operation of said clock.

3. In an automatic missile guidance system as set forth in claim 1, the improvement wherein said detector is a position sensing detector having four outputs for providing respective vertical and horizontal position outputs in response to said received signal from said array.

* * * * *